US009934702B2

(12) United States Patent
Harshman

(10) Patent No.: US 9,934,702 B2
(45) Date of Patent: Apr. 3, 2018

(54) MAGNETIC CARDETTE

(71) Applicant: Syndicate Sales, Inc., Kokomo, IN (US)

(72) Inventor: Trent Harshman, Galveston, IN (US)

(73) Assignee: Syndicate Sales, Inc., Kokomo, IN (US)

( * ) Notice: Subject to any disclaimer, the term of this patent is extended or adjusted under 35 U.S.C. 154(b) by 0 days.

(21) Appl. No.: 14/883,942

(22) Filed: Oct. 15, 2015

(65) Prior Publication Data

US 2017/0110034 A1 Apr. 20, 2017

(51) Int. Cl.

| | |
|---|---|
| ***G09F 1/10*** | (2006.01) |
| ***G09F 7/04*** | (2006.01) |
| ***G09F 7/18*** | (2006.01) |
| ***G09F 23/00*** | (2006.01) |
| ***B42D 15/02*** | (2006.01) |

(52) U.S. Cl.

CPC ..... *G09F 1/10* (2013.01); *B42D 15/027* (2013.01); *G09F 7/04* (2013.01); *G09F 7/18* (2013.01); *G09F 23/00* (2013.01); *G09F 2007/1804* (2013.01); *G09F 2007/1843* (2013.01); *G09F 2007/1852* (2013.01)

(58) Field of Classification Search

CPC ..... G09F 3/12; G09F 7/14; G09F 7/18

See application file for complete search history.

(56) References Cited

U.S. PATENT DOCUMENTS

| | | | | |
|---|---|---|---|---|
| 4,310,978 | A | 1/1982 | Stern | |
| 5,269,083 | A * | 12/1993 | Vampatella | A47G 1/065 248/206.5 |
| 5,369,902 | A * | 12/1994 | Minster | G09F 3/12 156/306.6 |
| 6,253,478 | B1 * | 7/2001 | Kalavity | G09F 3/20 40/607.06 |
| 6,722,067 | B1 * | 4/2004 | Kennedy | G09F 7/18 40/606.01 |
| 2004/0055191 | A1 * | 3/2004 | Kresser | G09F 15/00 40/560 |
| 2005/0284011 | A1 * | 12/2005 | Todd | G09F 7/04 40/600 |

* cited by examiner

*Primary Examiner* — Cassandra H Davis

(74) *Attorney, Agent, or Firm* — Woodard, Emhardt, Moriarty, McNett & Henry LLP; William McKenna; Daniel Lueders

(57) ABSTRACT

A magnetic cardette for removably holding a card or sign. The cardette includes a stem insertable into a floral arrangement container. The top of the stem includes a plate of material that is attractable to the card, in turn, having a magnet thereon removably holding the card to the stem.

1 Claim, 4 Drawing Sheets

MAGNETIC CARDETTE

BACKGROUND OF THE INVENTION

Field of the Invention

The present invention relates generally to the field of magnetic keepsake greeting cards.

Description of the Prior Art

The present invention relates generally to greeting messages and designs that are provided on a variety of gifts. For example, a gift of a floral arrangement may include a card attached to the floral arrangement container having a particular message relating to the donor or recipient. These cards although attractable are typically discarded once the floral arrangement is received.

In many cases, the particular gift may be of such value that the recipient desires to retain the gift card. Unfortunately, the card and/or card holder accompanying the gift may not be structured in such a manner so as to allow the card to be retained and displayed in a meaningful manner Disclosed herein is a cardette wherein the greeting card may easily be removed from its holder accompanying the gift and displayed in a permanent manner.

Magnetically cards are known that are removably mounted to metal surfaces, such as a refrigerator door. Such a card has a magnet constructed rear surface mountable on the metal refrigerator door whereas the front surface of the card contains a particular greeting, design or other information.

SUMMARY OF THE INVENTION

One embodiment of the present invention is a magnetic cardette mountable to a floral arrangement container comprising a stake having a first end portion for removably insertable into a floral arrangement container. The stake further having a second end portion and a frame fixedly mounted to the second end portion of the stake. A card or sign is removably mounted to the frame. The card and the frame have mutually facing surfaces magnetically attracted together.

Another embodiment of the present invention is a greeting card arrangement mountable to a container of material comprising a stake having a first end portion for removably inserting into a container of material and a second end portion with longitudinal axis extending therebetween. A frame is fixedly mounted to the second end portion of the stake. The frame includes an outwardly facing frame surface. A card is removably mounted to the frame at an obtuse angle relative to the longitudinal axis. The card includes a greeting portion and a magnetic portion secured together. The magnetic portion is located adjacent the frame surface removably mounting the card thereto. The card may be separated from the frame and magnetically mounted remotely therefrom.

It is an object of the present invention to provide a magnetic keepsake greeting card originally provided with a floral arrangement or other gift that can be saved and used by the receiver.

A further object of the present invention is to provide a magnetic keepsake greeting card and card holder that may be marketed through various outlets including grocery accounts, growers, and retail florists for use in the delivery of floral arrangements.

A further object of the present invention is to provide an inexpensive structure for holding a greeting card to a floral arrangement or other such gift.

In addition, it is an object of the present invention is to provide a greeting card and holder combination wherein the greeting card portion may be removed and mounted to a metal surface.

Related objects and advantages of the present invention will be apparent from the following description.

DESCRIPTION OF THE PREFERRED EMBODIMENT

Figure 1:
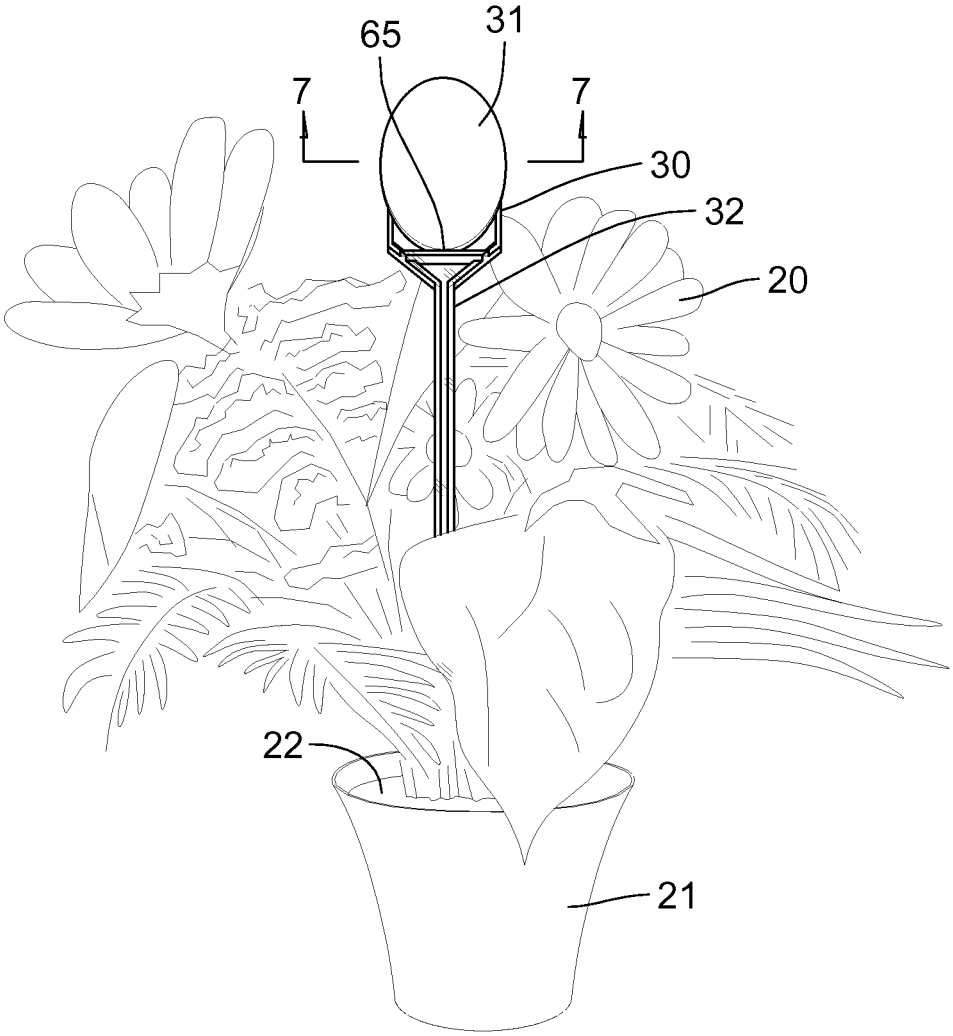
FIG. 1 is a perspective front view of a floral arrangement provided in a vase or other container with the magnetic cardette with card extending upwardly therefrom.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
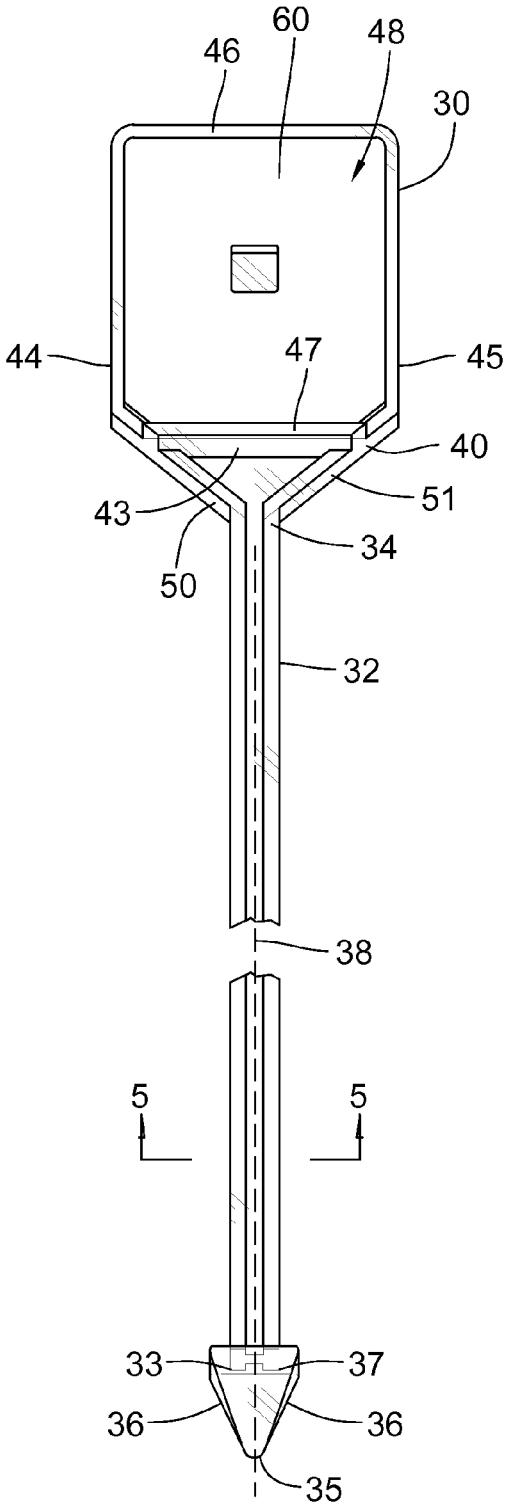
FIG. 2 is an enlarged fragmented front view of the cardette of FIG. 1 without the card.

Referring now more particularly to FIG. 1, there is shown a floral arrangement 20 extending upwardly from a standard vase or container 21. The container may be provided with material such as dirt or foam material 22 into which the stems of the plant extend. A magnetic cardette 30 (FIG. 2) is mountable to the floral arrangement container 21. Magnetic cardette includes a stake 32 having a top portion forming a frame 40 (FIG. 2) upon which is removably mounted a sign, a greeting card, or other card (FIG. 1) containing a message or a visual display.

Figure 4:
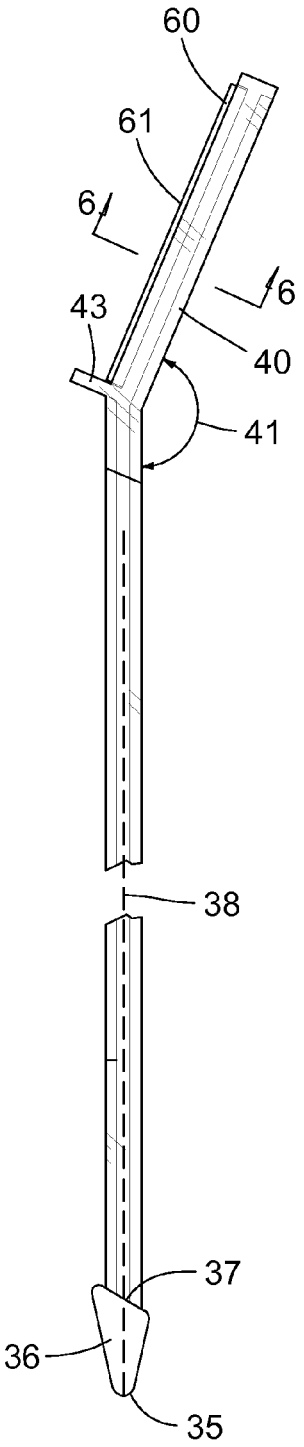
FIG. 4 is a fragmented right side view of the cardette shown in FIG. 2 with the left side view being a mirror image therefore.

Stake 32 (FIG. 2) has a first end portion 33 and a second end portion 34. The first end portion 33 has an arrow shape or configuration with a pointed bottom end 35 for insertion into container material 22. A plurality of side surfaces 36 extend divergently upward and outward from end 35 terminating in a flat surface 37 which is non-parallel relative to the longitudinal axis 38 (FIG. 4) extending from the top end portion 34 to the bottom end portion 33 of the stake. Thus, the stake may be inserted into the dirt or other material within the floral arrangement container with the tip 35 provided for easy insertion while the flat portions 36 and 37 secure the stake in place. In the event the arrow configured bottom end 33 is inserted fully into the container material, then the material will be positioned atop flat surface 37 securing a stake in an upright position.

Figure 5:
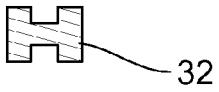
FIG. 5 is a cross-sectional view taken along a line and viewed in the direction of arrows 5-5 of FIG. 2.

Stake 32 has an H-shape cross-section (FIG. 5) to allow the stem of the stake to support the weight of the magnets located atop the stake. It is anticipated that the stake will be produced from plastic thereby emphasizing the need for a strong stem with the H configuration fulfilling such need.

Figure 3:
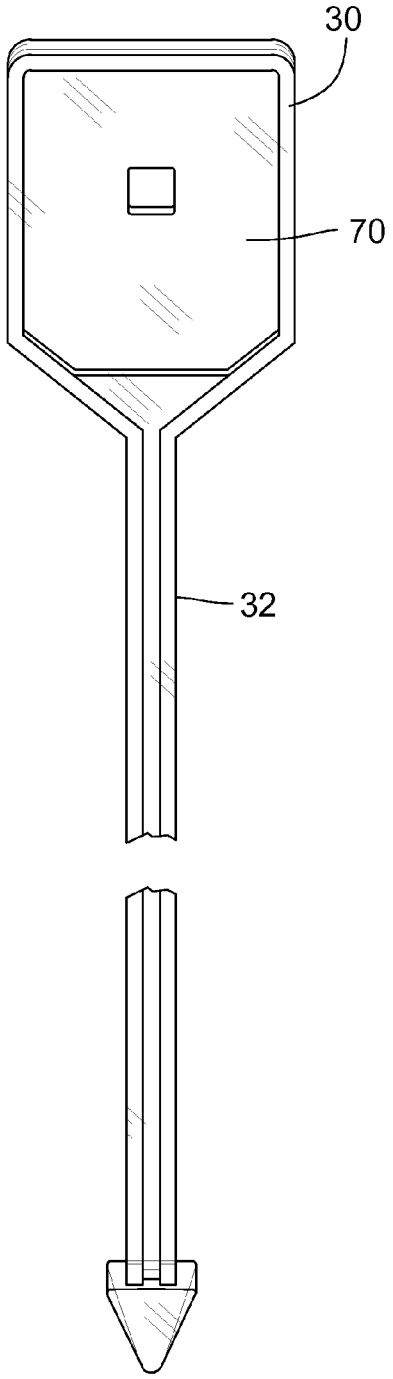
FIG. 3 is a fragmented rear view of the cardette of FIG. 2.

A frame 40 is fixedly mounted to the top portion 34 of the main body of the stake stem 32. The frame 40 is mounted or integrally connected at an obtuse angle 41 (FIG. 4) relative to the longitudinal axis 38 of stake 32. Frame 40 consists of a pair of upwardly extending side walls 44 and 45 (FIG. 2) joined to a top wall 46. Further, side walls 44 and 45 are joined to wall 47 in a generally rectangular configuration. A bottom wall 70 (FIG. 3) joined to walls 44-47 forms a recess 48 (FIG. 2) into which a metal plate or magnet 60 may be positioned resting atop bottom wall 70. Shelf 43 is located immediately beneath wall 47 and extends outwardly therefrom. Arms 50 and 51 are connected to stake 32 and extend outwardly being joined to side walls 44 and 45.

Figure 8:
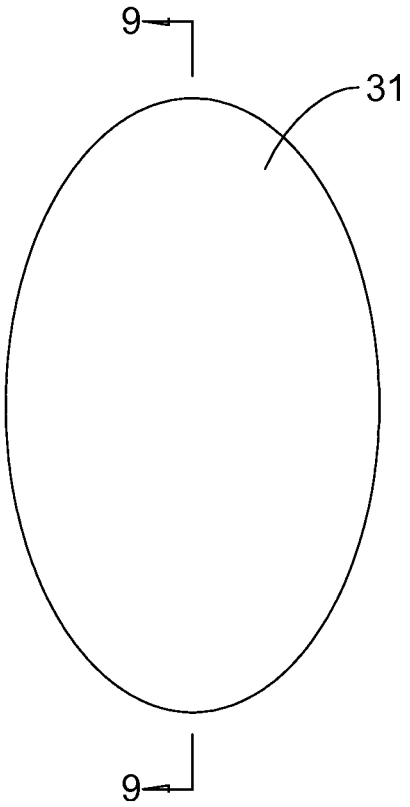
FIG. 8 is an enlarged front view of a sign removably mountable to the stake of FIG. 2.

Card 31 (FIGS. 8 & 9) comprises a magnetic portion 52 and a display portion 53 joined together. Display portion 53 may include a particular greeting to the recipient of the floral arrangement or may include a generic greeting. Further, a visual design including for example, a mountain scene or a lake scene etc. may be provided on display portion 53. Magnetic portion 52 consists of a conventional magnet integrally joined to the display portion 53. Alternatively, the display portion 53 may be painted, etched or otherwise formed on one side of the magnet portion 52.

Figure 6:
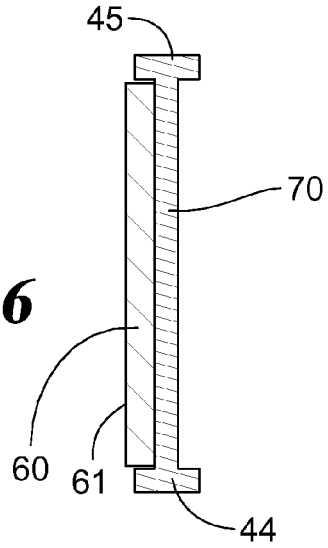
FIG. 6 is an enlarged cross-sectional view taken along a line and viewed in the direction of arrows 6-6 of FIG. 4.
Figure 7:
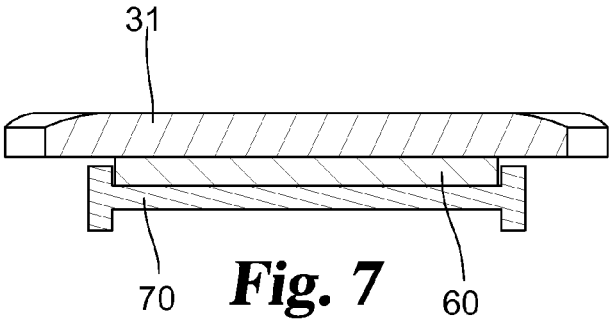
FIG. 7 is an enlarged cross-sectional view taken along a line and viewed in the direction of arrows 7-7 of FIG. 1 showing the card mounted to the cardette.

Plate 60 (FIG. 6) is mounted between walls 44-47 with the walls being sized relative to plate 60 to securely hold the plate thereto. For example, the metal plate may be snapped into the recess 48 formed by walls 44-47 with the spacing of the walls being such that spacing is slightly less than the width and length of the plate thereby holding the plate securely thereto. Plastic bottom wall 70 is joined to walls 44-47 and forms a seat upon which plate 60 rests. Plate 60 may either be a magnet or may be produced from metal having properties that are magnetically attractable to magnetic portion 52. For example, plate 60 may be a ferromagnetic material and could include iron, copper, nickel, cobalt and various alloys. Alternatively, the plate may be a magnet of a polarity such as allowing attraction to magnet portion 52 of sign 31.

Figure 9:
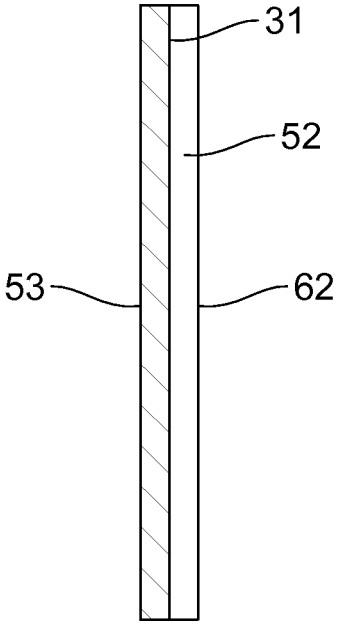
FIG. 9 is a cross-sectional view taken along a line and viewed in the direction of arrows 9-9 of FIG. 8

Plate 60 has an outwardly facing surface 61 (FIG. 4) that projects slightly above the outer ends of walls 44-47 allowing contact between surface 61 and surface 62 of magnet portion 52 (FIG. 9). The bottom end 65 (FIG. 1) of sign 31 may rest atop shelf 43 which keeps the card from sliding off or rotating. Card 31 has been removed from FIGS. 2-6 to more clearly illustrate the construction of the frame 40.

In the event the stake is mounted in an upright position with axis 38 extending vertically, then the outwardly facing surface 61 of plate 60 is tilted upwardly thereby tilting upward the card mounted thereon to facilitate ease of observation by a viewer. The card 31 (FIG. 1) is removably mounted to the upwardly tilted surface 61 and rests atop the shelf 43 integrally connected to frame 40. The card is removably mounted to frame 40 with the card and the plate having mutually facing surfaces magnetically attracted together. The card therefore may easily be removed from frame 40 and then mounted at a location remote from the stake. For example, the sign or card 31 may be mounted to a metal surface remote from the stake, such as a refrigerator door thereby allowing for the constant reminder and preservation of the greeting appearing thereon.

Many variations are contemplated and included in the present invention. For example, the card 31 is shown as having an oval configuration; however, the card may have a rectangular, triangular, or any other type of geometric shape.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A greeting card arrangement mountable to a container of material comprising:

a stake having a first end portion for removably inserting into a container of material and further having a second end portion, said stake further having a longitudinal axis extending from said first end portion to said second end portion;

a frame fixedly mounted to said second end portion of said stake, said frame includes an outwardly facing frame surface; and, a sign removably mounted to said frame at an obtuse angle relative to said longitudinal axis, said sign includes a greeting portion and a magnetic portion secured together, said magnetic portion located adjacent said frame surface removably mounting said sign thereto, said sign may be separated from said frame and magnetically mounted remotely therefrom; and wherein:

said frame includes a metal piece attractable by said magnetic portion, said frame further includes an outwardly facing recess having a plurality of walls including a bottom wall extending outwardly from said outwardly facing frame surface, said walls spaced apart to hold said metal piece in said recess; said frame includes a shelf located immediately beneath the bottom wall and projecting outwardly from only the bottom of said frame providing a seat upon which said sign rests, said shelf is of a non-magnetic material allowing said sign to be held only to said outwardly facing frame surface by said magnetic portion, wherein said outwardly facing frame surface is otherwise free from any outwardly extending projections so as to accommodate signs of varying shapes and sizes;

said stake extends into a container of material supporting said frame thereabove at an obtuse angle relative to said stake, said sign is a refrigerator door sign that is magnetically coupled to said frame when said stake extends into said container with said sign removable therefrom and subsequently mounted on a refrigerator door to provide a reminder of the greeting portion on the sign.

* * * * *